US010480293B2

(12) United States Patent
Langlais

(10) Patent No.: US 10,480,293 B2
(45) Date of Patent: Nov. 19, 2019

(54) TUBING SYSTEM HAVING ALTERNATE PATH

(71) Applicant: Schlumberger Technology Corporation, Sugar Land, TX (US)

(72) Inventor: Michael Dean Langlais, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 283 days.

(21) Appl. No.: 15/246,111

(22) Filed: Aug. 24, 2016

(65) Prior Publication Data

US 2017/0058647 A1 Mar. 2, 2017

Related U.S. Application Data

(60) Provisional application No. 62/212,112, filed on Aug. 31, 2015.

(51) Int. Cl.

| | |
|---|---|
| ***E21B 43/04*** | (2006.01) |
| ***E21B 43/08*** | (2006.01) |
| ***E21B 17/04*** | (2006.01) |
| ***E21B 17/18*** | (2006.01) |

(52) U.S. Cl.

CPC ..... *E21B 43/045* (2013.01); *E21B 17/04* (2013.01); *E21B 17/18* (2013.01); *E21B 43/08* (2013.01)

(58) Field of Classification Search

CPC ..... E21B 17/04; E21B 17/18; E21B 19/10; E21B 33/042; E21B 43/04; E21B 43/045; E21B 43/08; E21B 33/0422

See application file for complete search history.

(56) References Cited

U.S. PATENT DOCUMENTS

| | | | | |
|---|---|---|---|---|
| 5,390,966 | A * | 2/1995 | Cox | E21B 17/04 166/241.6 |
| 5,518,072 | A * | 5/1996 | McTernaghan | E21B 23/02 166/115 |
| 5,868,200 | A | 2/1999 | Bryant et al. | |
| 5,890,533 | A | 4/1999 | Jones | |
| 6,752,207 | B2 | 6/2004 | Danos et al. | |
| 7,267,168 | B1 * | 9/2007 | Sipos | E21B 19/10 166/75.14 |
| 7,493,959 | B2 | 2/2009 | Johnson et al. | |

(Continued)

OTHER PUBLICATIONS

Bakerhughes.com, EXCELLPAK Multipath Gravel-Pack Screen, 2 pgs.

(Continued)

*Primary Examiner* — Robert E Fuller
*Assistant Examiner* — Christopher J Sebesta

(57) ABSTRACT

A technique facilitates assembly and deployment of a sand screen assembly string. The sand screen assembly string is constructed by providing sequential base pipe joints combined with corresponding alternate path tubes. The sequential base pipe joints are joined together in a manner which brings sequential, corresponding alternate path tubes into close proximity with each other at a location external to the sequential base pipe joints. The sequential, corresponding alternate path tubes are readily coupled together by a connector which is movably mounted along at least one of the alternate path tubes for movement into engagement with the other alternate path tube.

20 Claims, 14 Drawing Sheets

(56) References Cited

U.S. PATENT DOCUMENTS

| | | | | |
|---|---|---|---|---|
| 7,866,708 | B2 | 1/2011 | Johnson et al. | |
| 7,971,642 | B2 | 7/2011 | Yeh et al. | |
| 8,011,437 | B2 | 9/2011 | Yeh et al. | |
| 8,893,789 | B2 | 11/2014 | Cunningham et al. | |
| 2006/0279078 | A1* | 12/2006 | Johnson | E21B 17/02 285/27 |
| 2008/0142227 | A1 | 6/2008 | Yeh et al. | |
| 2014/0014314 | A1* | 1/2014 | Cunningham | E21B 43/04 166/51 |
| 2014/0027115 | A1* | 1/2014 | Sanders | E21B 43/04 166/278 |
| 2014/0158373 | A1* | 6/2014 | Least | E21B 17/046 166/380 |
| 2014/0262538 | A1* | 9/2014 | Louviere | E21B 19/10 175/423 |
| 2015/0233216 | A1 | 8/2015 | Rodrigue et al. | |
| 2017/0058647 | A1* | 3/2017 | Langlais | E21B 43/045 |

OTHER PUBLICATIONS

Bakerhughes.com, EXCELLPAK Multipath Gravel-Pack Screen, 1 pg.

Bakerhughes.com, 2014 Offshore Technology Conference, 5 pgs.

International Search Report and Written Opinion for corresponding PCT Application Serial No. PCT/US2016/049342, dated Nov. 25, 2016, 13 pages.

* cited by examiner

TUBING SYSTEM HAVING ALTERNATE PATH

BACKGROUND

Sand screens are used in many types of wells to prevent formation sand from being produced to the surface and to thus avoid detrimental, operational issues, e.g. erosion of equipment. Sand screens often are used in combination with gravel packs which also serve to remove particulates from inflowing fluids, e.g. inflowing hydrocarbon fluids. To bypass annular bridging during gravel packing operations, alternate path technology is sometimes employed to improve the gravel packing of voids which can otherwise exist due to formation of the annular bridges. Alternate path technology provides an alternate path along which gravel slurry can flow in addition to the normal flow of gravel slurry along the primary path in the wellbore annulus. The alternate flow path may be formed with tubes which run parallel to a sand screen assembly base pipe. However, coupling the sequential alternate path tubes when the sequential base pipe joints are connected can present substantial alignment and connection challenges. The coupling of sequential alternate path tubes also can incur substantial costs, including the costs of rig time during coupling of the alternate path tubes as the sand screen assembly string is assembled and run in hole.

SUMMARY

In general, a system and methodology are provided for facilitating assembly and deployment of a sand screen assembly string. The sand screen assembly string is constructed by providing sequential base pipe joints combined with corresponding alternate path tubes. The sequential base pipe joints are joined together in a manner which brings sequential, corresponding alternate path tubes into close proximity with each other at a location external to the sequential base pipe joints. The sequential, corresponding alternate path tubes are then joined by a connector which is movably mounted along at least one of the alternate path tubes for movement into engagement with the corresponding, sequential alternate path tube.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
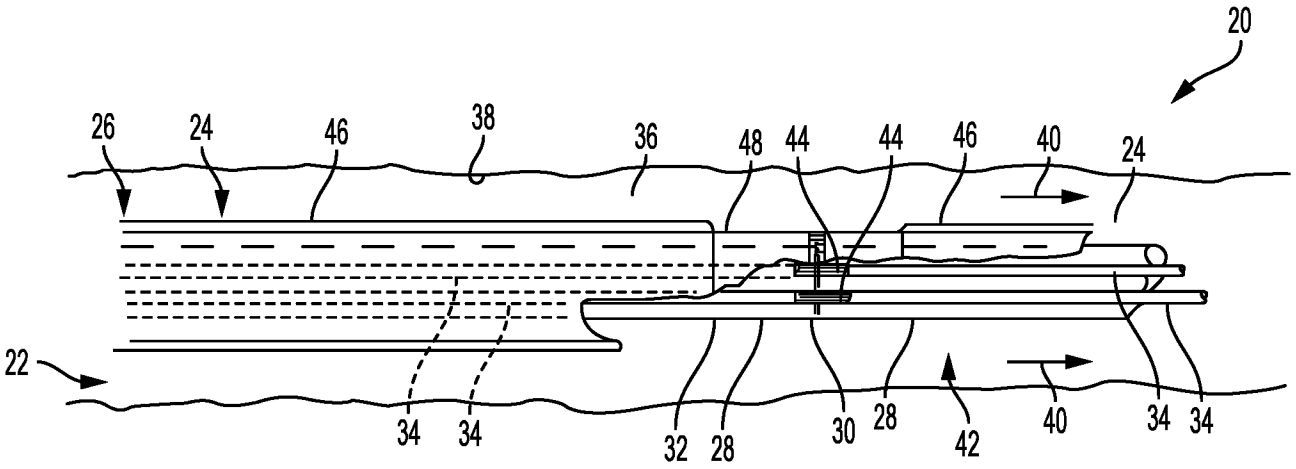
FIG. 1 is a schematic illustration of an example of a sand screen assembly string deployed in a wellbore, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally relates to a gravel packing system which employs a sand screen assembly string constructed to facilitate the formation of gravel packs in wellbores. In general, the gravel packing system may be constructed so that gravel slurry is delivered downhole along a primary flow path which extends into an annulus, thus facilitating distribution of gravel slurry into this annulus between the sand screen assembly string and the surrounding wellbore wall. The sand screen assembly string also comprises alternate path tubes, e.g. transport tubes and/or packing tubes, which provide the gravel slurry with an alternate flow path to ensure uniform gravel packing along the annulus.

The sand screen assembly string may comprise a plurality of sand screen assembly joints which are joined together as the string is assembled and run in hole. Although the components may vary, an embodiment of a sand screen assembly joint may comprise a base pipe with one or more perforations, at least one alternate path tube, a sand screen which provides filtration, and a pass-through structure which facilitates passage of the at least one alternate path tube from one sand screen assembly joint to the next. Depending on the application, a variety of other components, such as packers, inflow control devices, and other gravel packing or production components, may be selected to facilitate gravel packing and later production.

In an embodiment, a system and methodology are provided for facilitating assembly and deployment of the sand screen assembly string. By way of example, the sand screen assembly string may be constructed by coupling together sequential sand screen assembly joints which each comprise a base pipe joint having one or more perforations and at least one corresponding alternate path tube. The sequential base pipe joints are joined together in a manner which brings sequential, corresponding alternate path tubes into close proximity with each other at a location external to the sequential base pipe joints. The ability to place corresponding alternate path tubes into close proximity prevents or minimizes erosion susceptibility of the upstream-facing leading edge of the alternate path tube, e.g. shunt tube. By way of example, the sequential base pipe joints may have cooperating box and pin ends with timed threads to facilitate alignment of the corresponding alternate path tubes. The sequential, corresponding alternate path tubes may then be joined together by a connector which is movably mounted on at least one of the alternate path tubes for simple movement into engagement with the other alternate path tube.

It should be noted that at least some of the embodiments described herein can be assembled without precise alignment of the sequential alternate path tubes. When, for example, two sand screen assembly joints are to be made-up, the base pipe joints may be threaded together so that the alternate path tubes are somewhat aligned. The sequential, alternate path tubes may then be manipulated into alignment so that a connector may be moved to a position connecting the ends of the sequential, alternate path tubes. The structures described herein enable use of connectors for coupling the alternate path tubes, thus allowing selection of alternate path tube connectors having thinner walls formed of a lower yield strength material than would otherwise be employed in, for example, a housing for an annular coaxial slurry flow region.

By employing the alternate path tube connection techniques described herein, construction of the overall sand screen assembly string is simplified and also provides reliable make-up and robustness for rotating while running in hole. For example, the sand screen assembly string may be constructed without conventional jumper tubes, without a split shroud, and without leak-off tubes. The leak-off tubes may be eliminated because the sand screen assembly joints may be constructed so that the sand screen filter extends into close proximity, e.g. within 1-2 feet, of the end of the base pipe joint. This embodiment results in approximately 2-4 feet of no sand screen filter between sand screen assemblies at each joint-to-joint connection. This relatively short length is readily dehydrated via the portions of the sand screen filters adjacent this region and thus the leak-off tubes may be omitted.

Similarly, conventional jumper tubes may be omitted because short, movable, e.g. sliding, connectors may be employed to couple the closely spaced ends of the sequential alternate path tubes. According to an embodiment, the alternate path tube length is made nearly equal to the length of the pin-by-pin base pipe length plus the length of a coupling shoulder. In an example, the alternate path tube may be approximately ⅛ to ⅜ of an inch shorter than the length of the corresponding base pipe measured between pin ends plus the length of the coupling shoulder. Consequently, the gap between sequential, alternate path tubes after make-up may be minimized and the length of the connector between the sequential, alternate path tubes may similarly be minimized. Additionally, such close end-to-end alternate path tube proximity minimizes shunt tube leading edge susceptibility to erosion as flow disturbances are minimized at the alternate path tube end-to-end junction.

Referring generally to FIG. 1, an example of a gravel packing system 20 is illustrated as deployed in a wellbore 22. The gravel packing system 20 comprises a plurality of screen assembly joints 24 coupled together into a sand screen assembly string 26. Each screen assembly joint 24 comprises a base pipe joint 28, and the sequential base pipe joints 28 are coupled together via base pipe joint connectors 30, e.g. pin and box connectors, to form an overall base pipe 32. Each base pipe joint 28 may be perforated to enable lateral flow of fluid therethrough.

Additionally, each screen assembly joint 24 comprises an alternate path tube 34 or, as illustrated, a plurality of alternate path tubes 34 routed along an exterior of the corresponding base pipe joint 28. In some applications, however, internal shunts may be employed between screen and base pipe while still incorporating the alternate path tube connection described herein. In an embodiment, the alternate path tubes 34 may comprise transport tubes for providing an alternate flow path for gravel slurry. The alternate path tubes 34 also may comprise packing tubes which have outlets for distributing the gravel slurry to desired locations along an annulus 36 disposed between the sand screen assembly string 26 and a surrounding wellbore wall 38. Regardless, the alternate path tubes 34 provide an alternate flow path for gravel slurry 40 relative to a primary flow path 42 along the annulus 36.

The alternate path tubes 34, e.g. transport tubes, are positioned externally of each base pipe joint 28 and may be connected with the next sequential, corresponding alternate path tubes 34 of the next sequential base pipe joint 28 via connectors 44. As described in greater detail below, each connector 44 may be movably, e.g. slidably, mounted at an end of an alternate path tube 34 associated with one base pipe joint 28 and moved, e.g. slid, into engagement with the corresponding, sequential alternate path tube 34 associated with the next base pipe joint 28. In some embodiments, the connectors 44 may be slid or otherwise moved downwardly from an upper screen assembly joint 24 toward a lower screen screen assembly joint 24. In other embodiments, however, the connectors 44 may be slid or otherwise moved upwardly from a lower screen assembly joint 24 toward an upper screen assembly joint 24.

For example, sequential base pipe joints 28 may be coupled together via threaded engagement in a manner which generally aligns the ends of sequential, corresponding alternate path tubes 34 associated with the sequential base pipe joints 28. The connectors 44 are then moved to couple the corresponding alternate path tubes 34 and to thus form a longer alternate path tube 34 which provides an alternate fluid flow path through the joined screen assembly joints 24.

In a variety of applications, the sand screen assembly string 26 may comprise various other components. For example, each screen assembly joint 24 may comprise a screen 46 which serves as a filter media for filtering out particulates before they can flow to the perforated base pipe joints 28. The flow into base pipe joints 28 may be directed with or without inflow control devices. Between screens 46, the sand screen assembly string 26 may comprise pass-through structures 48. The alternate path tubes 34 may be routed externally of screens 46. However, in at least some applications, the alternate path tubes 34 may extend longitudinally along the exterior of base pipe 32 and through or within the corresponding screens 46 and pass-through structures 48. The pass-through structures 48 may be formed with cooperating connection end sleeves as discussed in greater detail below.

Figures 2, 3, 4, 5:
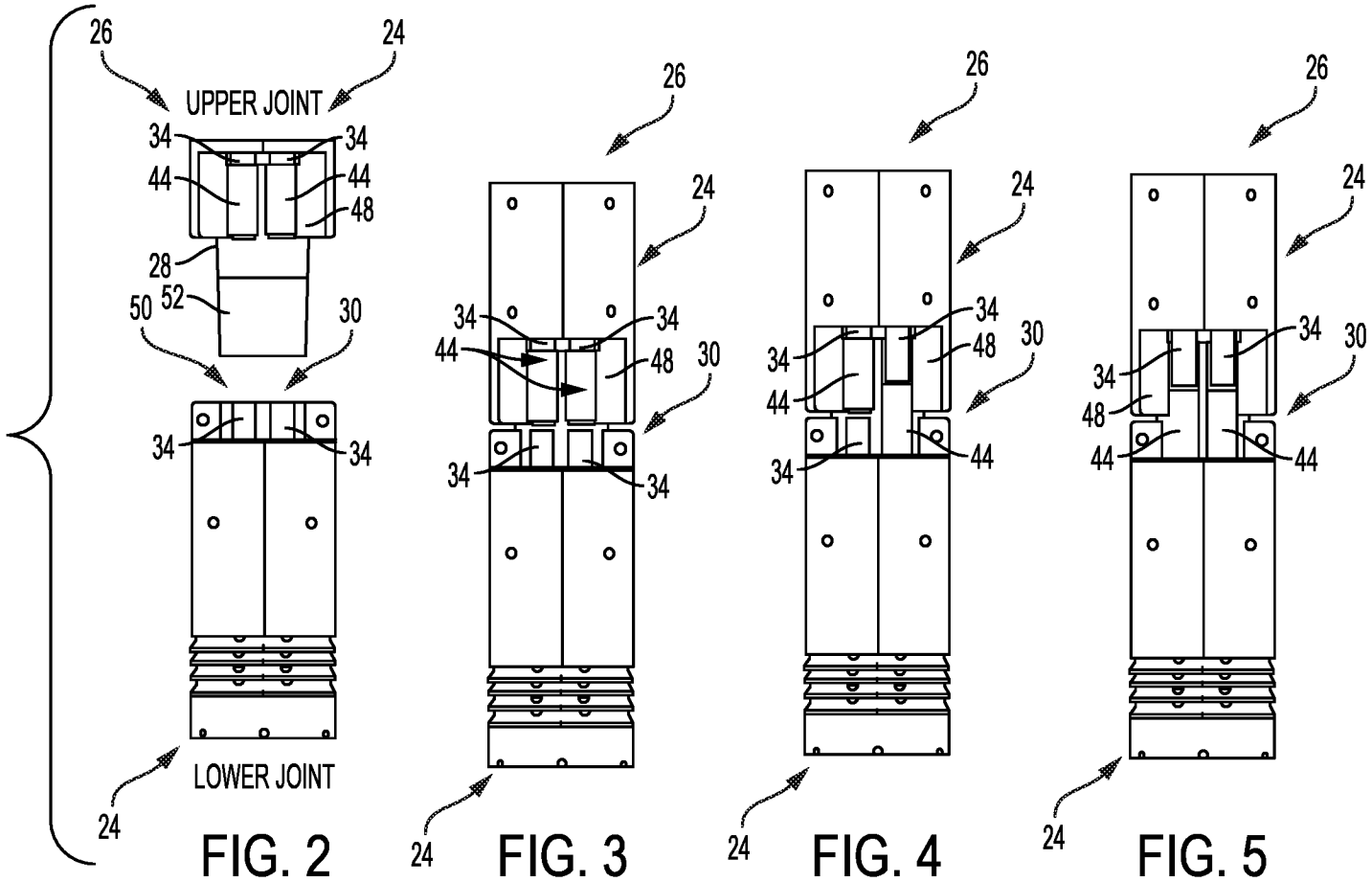
FIG. 2 is an illustration of an example of first and second base pipe joints with corresponding alternate path tubes being coupled together, according to an embodiment of the disclosure.
FIG. 3 is an illustration similar to that of FIG. 2 but at a subsequent stage of coupling, according to an embodiment of the disclosure.
FIG. 4 is an illustration similar to that of FIG. 3 but at a subsequent stage of coupling, according to an embodiment of the disclosure.
FIG. 5 is an illustration similar to that of FIG. 4 but at a subsequent stage of coupling, according to an embodiment of the disclosure.

Referring generally to FIGS. 2-5, an operational example is illustrated for coupling, e.g. making-up, a first screen assembly joint 24 to a second screen assembly joint 24. In this example, a box end 50 of a first base pipe joint 28 is positioned to threadably receive a corresponding pin end 52 of a second base pipe joint 28, as illustrated in FIG. 2. The base pipe joints 28 are then threaded together until the corresponding sections of alternate path tubes 34 are generally aligned, as illustrated in FIG. 3. In this embodiment and other embodiments described herein, the sequential base pipe joints 28 are joined together in a manner which brings sequential, corresponding alternate path tubes 34 into close proximity with each other at a location external to the sequential base pipe joints 28. The ability to place corresponding alternate path tubes 34 into close proximity prevents or minimizes erosion susceptibility of the upstream-facing leading edges of the alternate path tubes 34, e.g. shunt tubes. It should be noted that the box end 50 and pin end 52 may employ timed threads to facilitate alignment of the corresponding, sequential alternate path tubes 34.

Once the corresponding segments of the alternate path tubes 34 are aligned, the connectors 44 may be moved so as to couple the sequential segments of the alternate path tubes 34, as illustrated in FIGS. 4 and 5. By way of example, each connector 44 may be in the form of a sleeve slidably mounted to the end of an alternate path tube 34 associated with, for example, the second base pipe joint 28. In some embodiments, the connector 44 may be in the form of a single component with a plurality of combined sleeves having independently sealable passageways. After alignment with the corresponding end of the alternate path tube 34 associated with the first base pipe joint 28, the connector 44 is simply slid until the corresponding ends of the alternate path tubes 34 are both engaged. Effectively, the connector 44 couples corresponding, sequential alternate path tubes 34 into a single alternate path tube extending past the junction between base pipe joints 28. In a variety of applications, appropriate seals, e.g. O-ring seals, may be mounted within the connectors 44 or along the alternate path tubes 34 so as to form a sealed connection between the connector 44 and the sequential, corresponding alternate path tubes 34.

In some applications, the ends of at least some of the alternate path tubes 34 are provided with space for lateral movement to facilitate alignment with the corresponding, sequential alternate path tubes 34. According to one embodiment, the alternate path tubes 34 are routed through slots 54 within the pass-through structure 48, as illustrated in FIGS. 6-9. The slots 54 have a lateral dimension which allows lateral movement of the alternate path tubes 34 within slots 54, thus helping align alternate path tubes 34 of one screen assembly joint 24 with those of the next sequential screen assembly joint 24.

Figure 6:
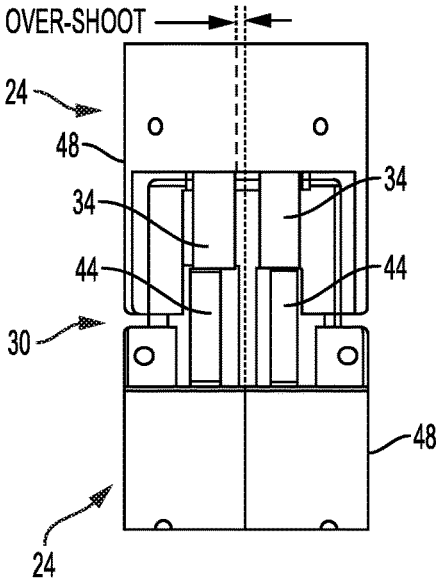
FIG. 6 is an illustration of first and second base pipe joints coupled together along with corresponding alternate path tubes, according to an embodiment of the disclosure.
Figure 8:
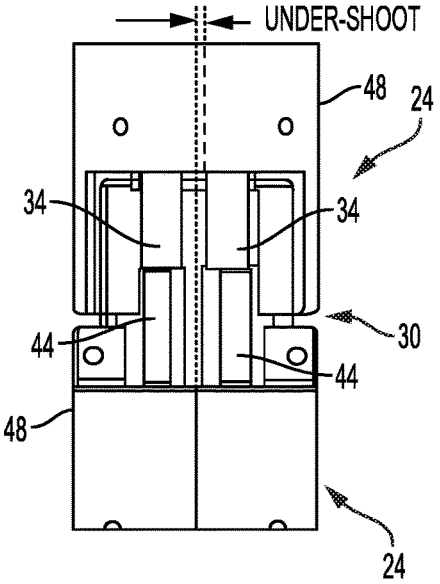
FIG. 8 is another illustration of first and second base pipe joints coupled together along with corresponding alternate path tubes, according to an embodiment of the disclosure.
Figure 7:
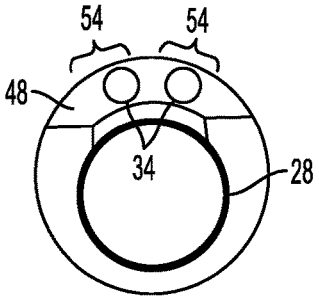
FIG. 7 is a cross-sectional view of the assembly illustrated in FIG. 6, according to an embodiment of the disclosure.
Figure 9:
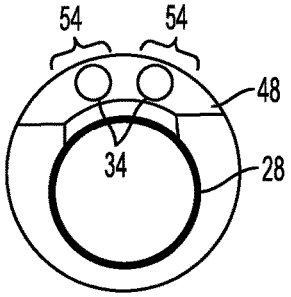
FIG. 9 is a cross-sectional view of the assembly illustrated in FIG. 8, according to an embodiment of the disclosure.

As illustrated in FIGS. 6-7, the slots 54 may be sized to enable alignment of alternate path tubes 34 even with a certain degree of over-shoot during make-up of the corresponding base pipe joints 28. Similarly, the slots 54 may be sized to enable alignment of the alternate path tubes 34 even with a certain degree of under-shoot during make-up of the corresponding base pipe joints 28, as illustrated in FIGS. 8-9. The slots 54 may be constructed to allow sufficient lateral flexing of the alternate path tubes 34 to enable alignment over a given range of over-shoot or under-shoot. By way of example, the slots 54 may be sized to enable 1-10°, e.g. 3.5°, of over-shoot or 1-10°, e.g. 3.5°, of under-shoot with respect to the threaded engagement of corresponding base pipe joints 28.

Figure 12:
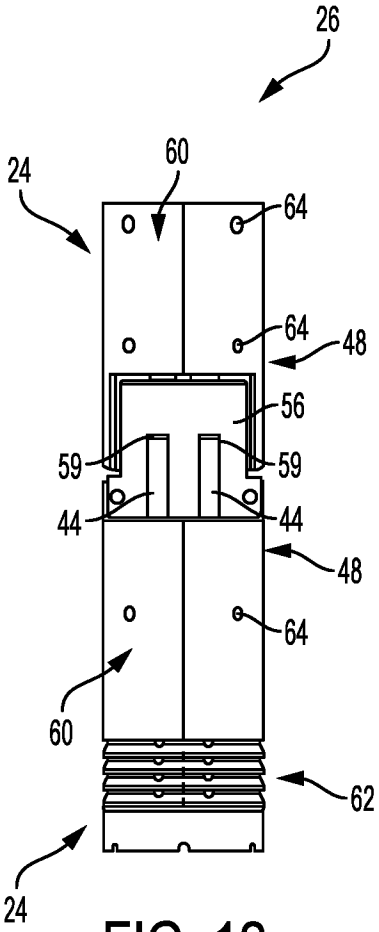
FIG. 12 is a side view similar to that of FIG. 11 but from a different orientation, according to an embodiment of the disclosure.
Figure 11:
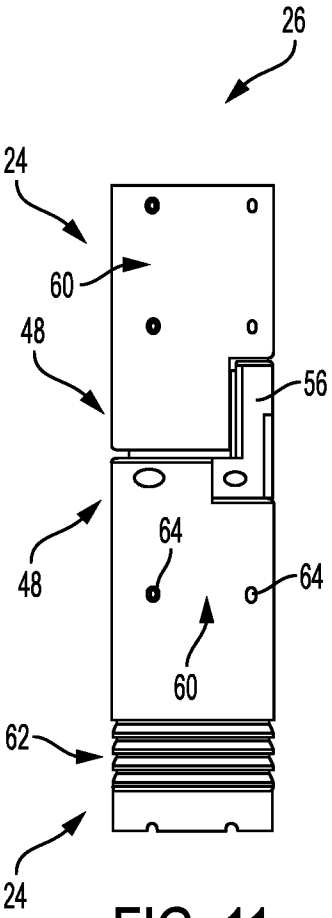
FIG. 11 is a side view similar to that of FIG. 10 but showing the cap mounted in place along the base pipe, according to an embodiment of the disclosure.
Figure 10:
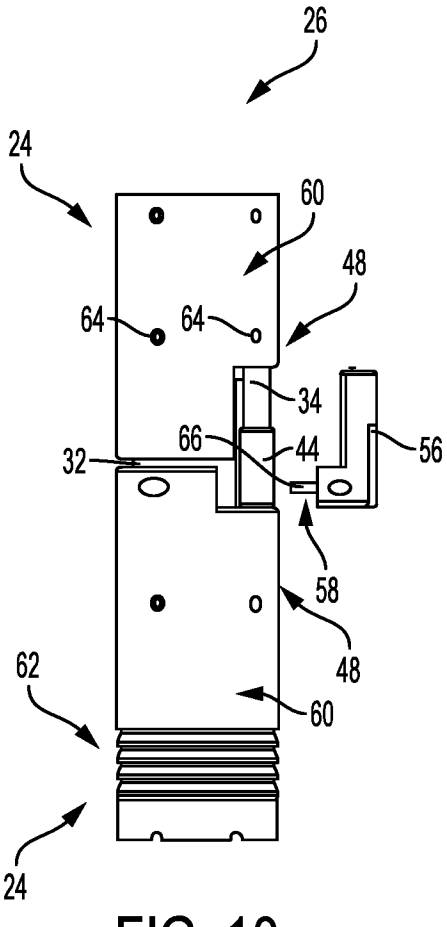
FIG. 10 is a side view of an example of the sand screen assembly string with a cap positioned for releasable attachment so as to cover the alternate path tube connectors, according to an embodiment of the disclosure.

Referring generally to FIGS. 10-12, an embodiment is illustrated in which a cap 56 is used to enclose the connector or connectors 44 once the corresponding alternate path tubes 34 are coupled together between sequential screen assembly joints 24. Once the connectors 44 are moved into the engaged position, as illustrated in FIG. 10, the cap 56 may be engaged with the same screen assembly string 26 at a position which covers and protects both the connectors 44 and the alternate path tubes 34, as illustrated in FIGS. 11 and 12. In some embodiments, the cap 56 comprises an engagement feature 58 oriented for engagement with, for example, one of the base pipe joints 28 or with a corresponding pass-through structure 48. Additionally, the engagement feature 58 may be in the form of a releasable feature to allow removal of cap 56 when desired. In some applications, the cap 56 also may comprise a connector lock 59. The connector lock 59 may be in the form of a recess having a length and width sized to receive the corresponding connector or connectors 44, as illustrated, to prevent inadvertent disengagement of the connectors 44 from the mating alternate path tubes 34 until cap 56 is removed.

In FIGS. 10-12, the screen assembly joints 24 are illustrated to show various sides of the pass-through structures 48. As explained in greater detail below, the pass-through structures 48 may be constructed to provide gripping regions 60 which facilitate making up to sequential joints 24 on a rig. The gripping regions 60 may have a variety of configurations which may include flat sides or other features which facilitate make-up of sequential screen assembly joints 24 on the rig. In some applications, portions of at least some of the pass-through structures 48 or other cooperating components may comprise a series of load shoulders 62 which may be used to support and hold the same screen assembly string 26 during make-up on the rig, as explained in greater detail below. The pass-through structures 48 may be secured to the base pipe 32 by suitable fasteners 64, e.g. threaded screws. Additionally, the cap 56 may be constructed in a suitable configuration to effectively maintain this smooth outside diameter.

Figure 13:
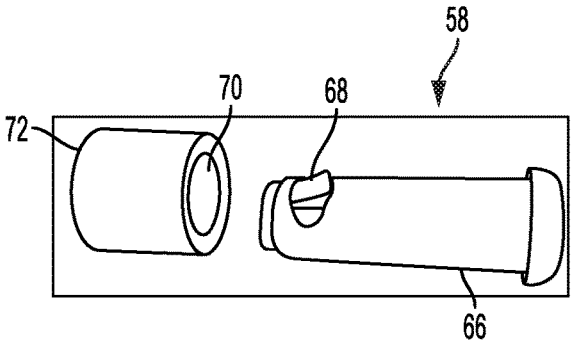
FIG. 13 is an illustration of an example of a coupling mechanism which may be used to releasably engage the cap with the sand screen assembly string, according to an embodiment of the disclosure.
Figure 14:
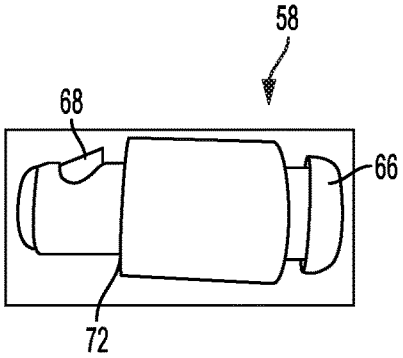
FIG. 14 is an illustration of the coupling mechanism illustrated in FIG. 13 in a fully engaged position, according to an embodiment of the disclosure

In some applications, the engagement feature 58 may be in the form of a pin or pins 66, such as releasable clevis pins. Referring generally to FIGS. 13 and 14, an embodiment of engagement feature 58 is illustrated. In this embodiment, the engagement feature 58 comprises at least one pin 66 having a spring-loaded member 68. The pin 66 and spring-loaded member 68 are pushed into a corresponding recess 70 formed in, for example, the appropriate base pipe joint 28 or pass-through structure 48. The spring-loaded member 68 is pressed radially inwardly as the pin 66 is inserted along recess 70 until spring-loaded member 68 passes a retention edge 72. Once the spring-loaded member 68 moves past the retention edge 72, the spring-loaded member 68 is biased to a radially outward position and the pin 66 is prevented from being pulled out of the recess 70, as illustrated in FIG. 14.

Figure 15:
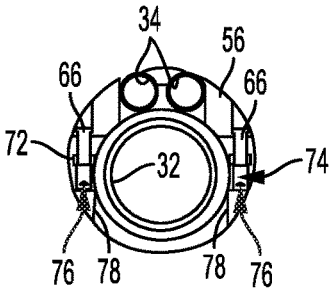
FIG. 15 is a cross-sectional of an example of the sand screen assembly string with the cap in position over the alternate path tube connectors, according to an embodiment of the disclosure.
Figure 16:
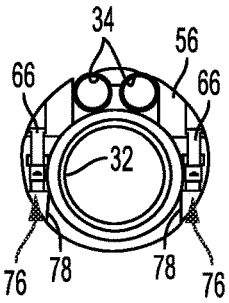
FIG. 16 is a cross-sectional view similar to that of FIG. 15 but showing release of the cap, according to an embodiment of the disclosure.
Figure 17:
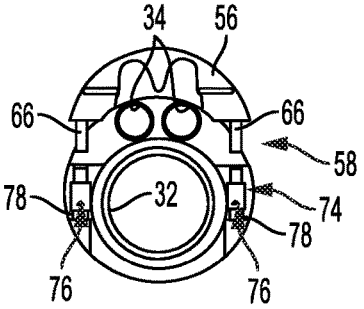
FIG. 17 is a cross-sectional view similar to that of FIG. 15 but showing removal of the cap, according to an embodiment of the disclosure.

An example of one type of engagement feature 58 that may be utilized to releasably engage cap 56 with sand screen assembly string 26 is illustrated in FIGS. 15-17. This embodiment of engagement feature 58 allows cap 56 to function as a snap-in cap which may be installed by hand after the sequential, corresponding alternate path tubes 34 are coupled together via the corresponding connector or connectors 44. The engagement feature 58 comprises a plurality of pins 66 and spring-loaded members 68. The corresponding recesses 70 are formed in pass-through structure 48 or in another suitable structure and spaced for receipt of pins 66. Once the pins 66 are fully inserted in recesses 70, the spring-loaded members 68 spring outwardly and engage edge 72 to prevent unwanted removal of cap 56, as illustrated in FIG. 15.

To enable selective removal of cap 56, a removal device 74 is used to selectively depress the spring-loaded member 68 in a radially inward direction to enable withdrawal of pins 66 from their corresponding recesses 70. By way of example, the removal device 74 may be in the form of previously installed set screws 76 threadably positioned in threaded bores 78 opposite the corresponding pins 66 and recesses 70. The set screws 76 are counterbored to fit relatively tightly around the corresponding pins 66 when the set screws 76 are threaded inwardly into engagement with corresponding pins 66, as illustrated in FIG. 16.

As the set screws 76 are threaded into threaded bores 78, the counter bores advance over the corresponding pins 66 forcing the spring-loaded members 68 to move radially inwardly. Once the spring-loaded members 68 are transitioned to the radially inward position, the pins 66 may be withdrawn from recesses 70 to enable removal of cap 56, as illustrated in FIG. 17. If desired, the cap 56 may simply be reattached by backing off the set screws 76 and inserting pins 66 into the corresponding recesses 70 until held in place via spring-loaded members 68 and corresponding edges 72.

Thus, cap 56 provides a selectively engageable protective cover which protects the connected alternate path tubes 34 and retains the connectors 44 in sealed, connected positions. In embodiments utilizing shroud 60, the cap 56 also may be shaped to provide a continued, smooth outside diameter along the sand screen assembly string 26 as illustrated.

Referring generally to FIGS. 18-21, an example is provided for construction or manufacture of the screen assembly joints 24 by assembling pass-through structures 48 to base pipe joints 28. As illustrated, the pass-through structure 48 may be in the form of (or comprise) a connection end sleeve 80 which is slidably positioned on one of the base pipe joints 28 during assembly of the screen assembly joint 24. In this example, the connection end sleeve 80 is mounted on box end 50 of one of the base pipe joints 28. The box end 50 is configured to threadably receive the corresponding pin end 52 of a second base pipe joint 28.

Figure 18:
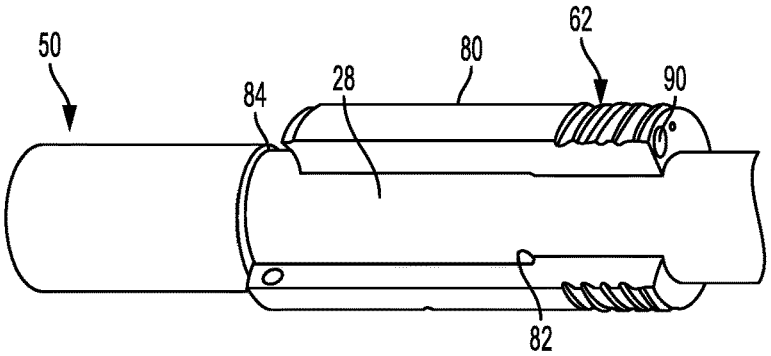
FIG. 18 is a partially broken away view of an example of a connection end sleeve assembly construction for forming a pass-through structure, according to an embodiment of the disclosure.
Figure 19:
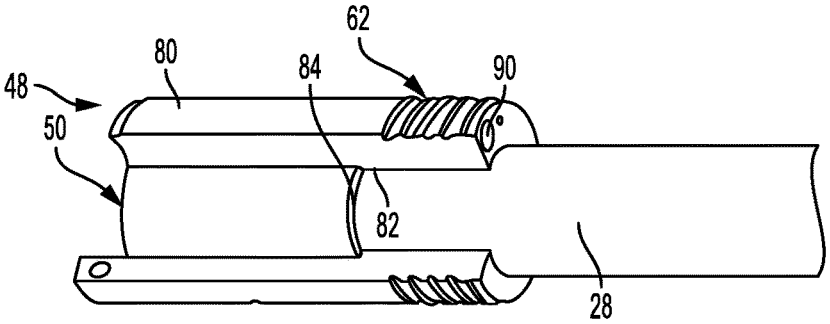
FIG. 19 is an illustration similar to that of FIG. 18 but showing a connection end sleeve in a different position, according to an embodiment of the disclosure.
Figure 20:
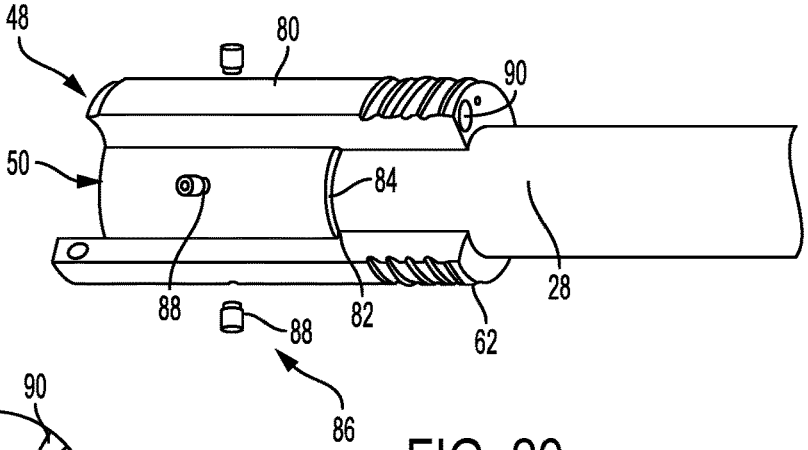
FIG. 20 is an illustration similar to that of FIG. 19 but showing the connection end sleeve in a different position, according to an embodiment of the disclosure.
Figure 21:
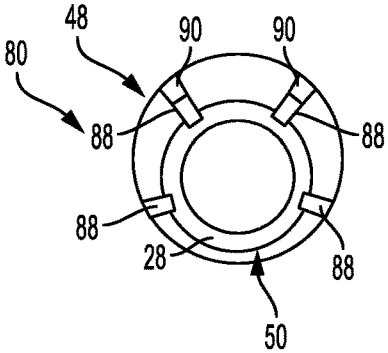
FIG. 21 is a cross-sectional view of an example of the connection end sleeve mounted to a base pipe joint, according to an embodiment of the disclosure.

As illustrated in FIG. 18, the connection end sleeve 80 is initially positioned in a retracted position. Then, the connection end sleeve 80 is slid into an operational position, as illustrated in FIG. 19. According to an embodiment, the connection end sleeve 80 is slid until an internal abutment edge 82 engages a shoulder 84 of box end 50. The connection end sleeve 80 may be held in this operational position by a suitable fastener 86, such as a plurality of set screws 88, as illustrated in FIG. 20. The set screws 88 may be threaded radially through the connection end sleeve 80 and into engagement with the base pipe joint 28, as illustrated in FIG. 21. In the example illustrated, set screws 88 engage the box end 50 but the set screws 88 also can be positioned to engage other portions of base pipe joint 28. As further illustrated in FIG. 21, the connection end sleeve 80 of pass-through structure 48 may comprise passages, e.g. passages 90, for receiving alternate path tubes 34 therethrough. As used herein, set screws, e.g. set screws 88, may comprise threaded rods with non-threaded shaft tips that fits inside cooperating counter bores in the corresponding base pipe or coupling. This type of set screw provides substantial strength when loaded in a shear direction.

Figure 22:
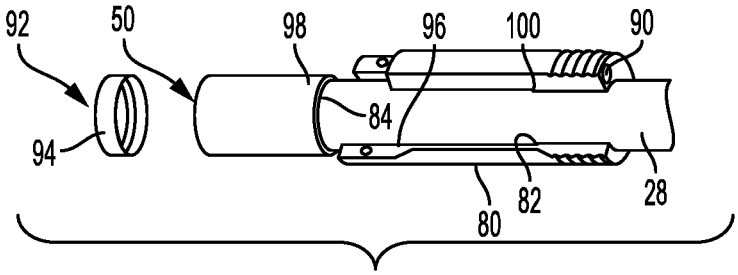
FIG. 22 is a partially broken away illustration of another embodiment of the connection end sleeve assembly, according to an embodiment of the disclosure.
Figure 23:
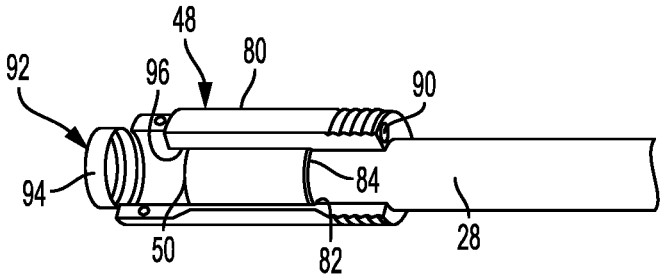
FIG. 23 is an illustration similar to that of FIG. 22 but showing a connection end sleeve in a different position, according to an embodiment of the disclosure.
Figure 24:
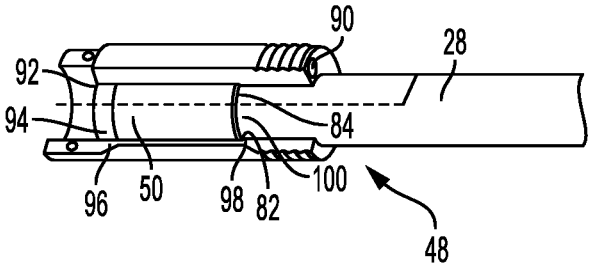
FIG. 24 is an illustration similar to that of FIG. 23 but showing the connection end sleeve in a different position, according to an embodiment of the disclosure.

Referring generally to FIGS. 22-24, another example of screen assembly joint construction is illustrated to show pass-through structure 48 having another embodiment of connection end sleeve 80. In this example, the connection end sleeve 80 is again initially slidably positioned on one of the base pipe joints 28. For example, the connection end sleeve 80 may be mounted on box end 50 of one of the base pipe joints 28 and the box end 50 which is configured to threadably receive the corresponding pin end 52 of a second base pipe joint 28.

According to an embodiment, the connection end sleeve 80 is slid until internal abutment edge 82 engages shoulder 84 of box end 50. The connection end sleeve 80 may be held in this operational position by an internal nut 92, as illustrated in FIGS. 22-24. In this example, the internal nut 92 comprises external threads 94 which engage an internally threaded region 96 of sleeve 80 to secure the connection end sleeve 80 in the operational position. In some embodiments, the box end 50 may be formed with features, e.g. notches, 98 which engage corresponding internal features, e.g. notches, 100 formed along the interior of connection end sleeve 80. When the connection end sleeve 80 is secured in position by internal nut 92, features 98 are engaged with corresponding features 100 to prevent rotation of the connection end sleeve 80 with respect to the base pipe joint 28.

Figure 26:
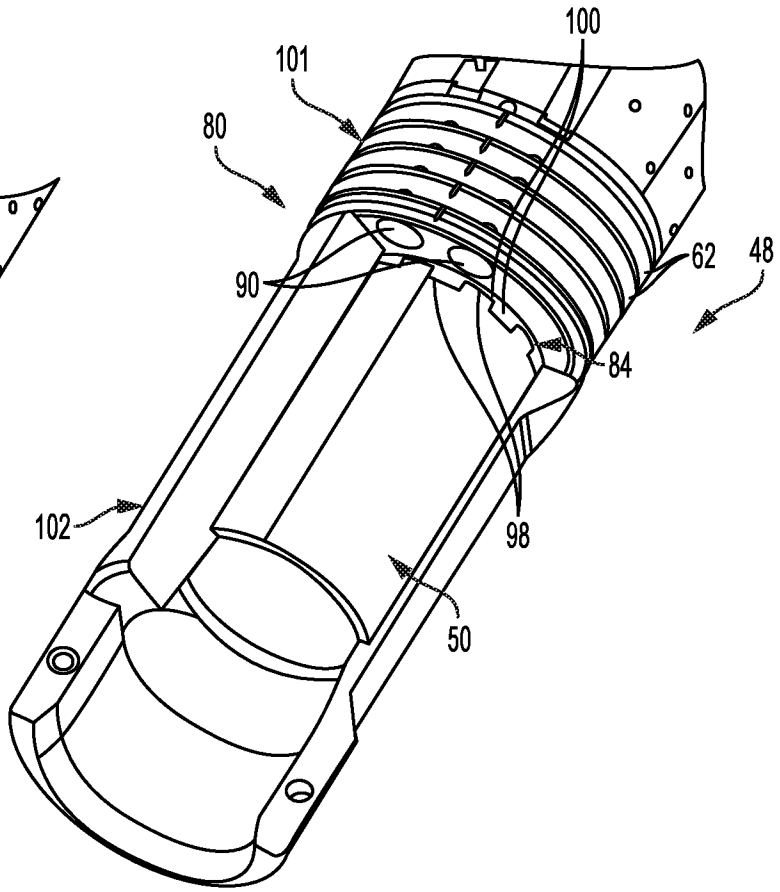
FIG. 26 is an illustration similar to that of FIG. 25 but showing a completed two component connection end sleeve for forming a pass-through structure, according to an embodiment of the disclosure.
Figure 25:
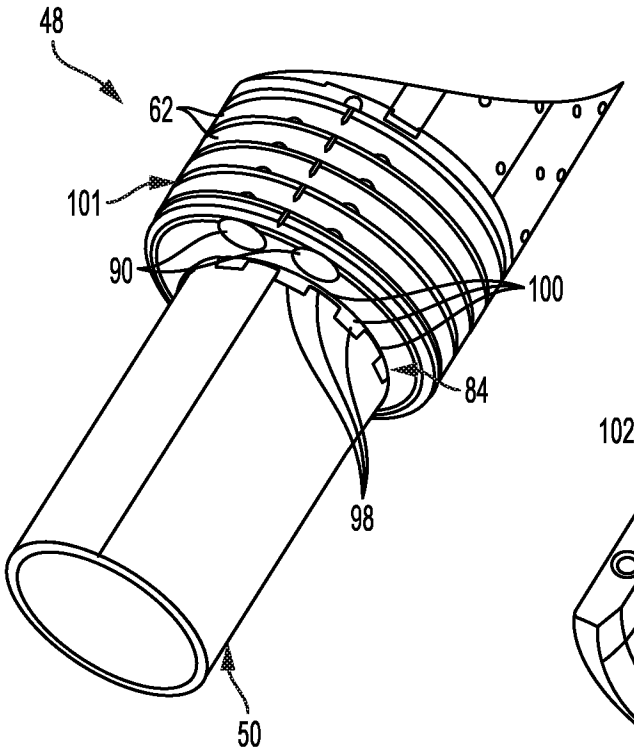
FIG. 25 is an illustration of another example of a connection end sleeve assembly combined with a base pipe, according to an embodiment of the disclosure.

Referring generally to FIGS. 25 and 26, another example of screen assembly joint construction is illustrated in which the pass-through structure 48 is assembled to the corresponding base pipe joint 28 via a two-part connection end sleeve 80. In this example, the connection end sleeve 80 is initially formed with two sleeve components 101, 102. The first sleeve component 101 is slid onto the corresponding base pipe joint 28 and moved into a loadbearing position with respect to box end 50 of the base pipe joint 28. For example, the first sleeve component 101 may comprise features 100, e.g. notches, which are received in the corresponding features 98, e.g. notches, formed along the longitudinally interior edge, e.g. along shoulder 84, of box end 50. Subsequently, the second sleeve component 102 may be slid over the box end 50 and fastened, e.g. welded, to the first sleeve component 101, as illustrated in FIG. 26. This assembly method securely attaches the pass-through structure 48 to the corresponding base pipe joint 28 and provides longitudinal and rotational load bearing capability via engagement of features 98 with corresponding features 100. The load bearing capability may be from both ends of box end coupling 50. For example, a majority of the load bearing may be from a bottom end of the box end coupling 50 when, for example, an actual joint is hanging from a screen table. However, load bearing also may occur from a top end of the box end coupling 50 on joints below the screen table or when, for example, a screen assembly is being pulled out of hole.

Once each screen assembly joint 24 is constructed, the overall sand screen assembly string 26 may be assembled by making-up sequential screen assembly joints 24 on, for example, a rig as described above with reference to FIGS. 2-5. Referring generally to FIGS. 27-30, another embodiment and technique for coupling, e.g. making-up, a first screen assembly joint 24 to a second screen assembly joint 24 is illustrated. In this example, the first and second screen assemblies 24 are constructed to facilitate threaded engagement of first and second base pipe joints 28 even though the first and second screen assemblies 24 are eccentrically formed to accommodate the alternate path tubes 34.

Figure 30:
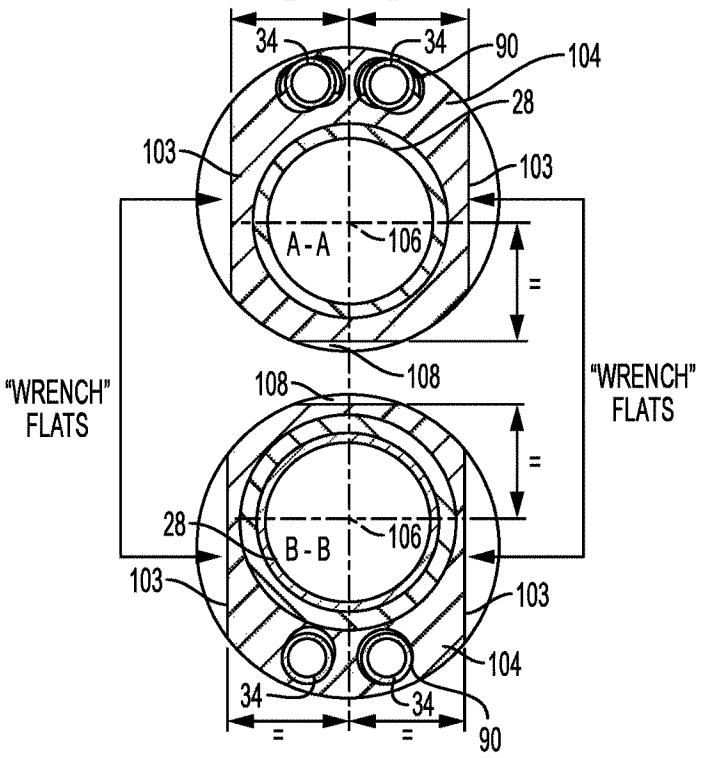
FIG. 30 is an illustration comparing two cross-sectional views taken generally along lines A-A and B-B of FIG. 27, according to an embodiment of the disclosure.
Figure 29:
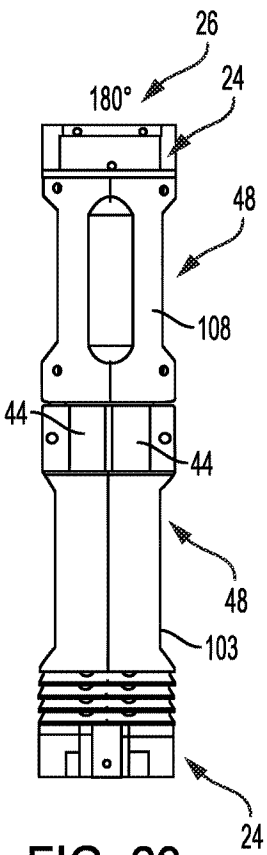
FIG. 29 is an illustration similar to that of FIG. 28 but showing the first and second base pipe joints in a different operational position during assembly, according to an embodiment of the disclosure.
Figure 28:
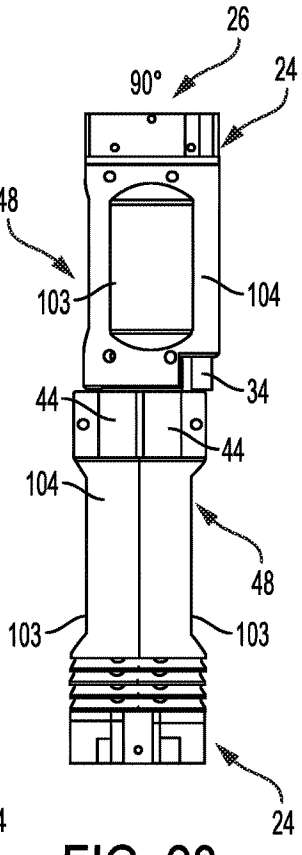
FIG. 28 is an illustration similar to that of FIG. 27 but showing the first and second base pipe joints in a different operational position during assembly, according to an embodiment of the disclosure.
Figure 27:
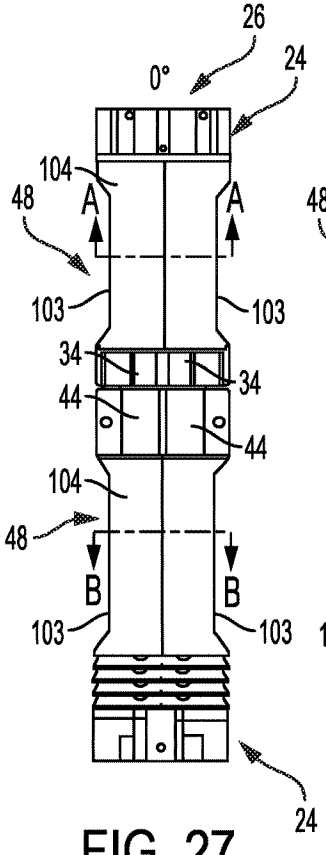
FIG. 27 is an illustration of another example of first and second base pipe joints being coupled together, according to an embodiment of the disclosure.

As illustrated in FIGS. 27-29, each screen assembly 24 may be formed with flat surfaces 103 formed in a corresponding sleeve 104 of the pass-through structure 48. The flat surfaces 103 are equidistant from a make-up thread axis 106 of the corresponding base pipe joints 28, as illustrated in FIG. 30. The equidistant flat surfaces 103 enable the use of, for example, bucking equipment for engaging the pass-through structures 48 via sleeves 104 in a manner similar to an open-end wrench engaging a nut or bolt head. The bucking equipment may utilize sets of tongs to engage the flat surfaces 103 of each adjacent sleeve 104. Because the flat surfaces 103 are equidistant from the make-up thread axis 106, there is little or no eccentric movement, e.g. wobbling, of the tongs relative to each other as the bucking equipment rotates (see FIGS. 27-29 which are rotated approximately 90° from each other). In some applications, an additional flat surface 108 (see FIGS. 29 and 30) may be located at an equal distance (or other suitable distance) from the make-up thread axis 106 to serve as a locating datum for the tongs of the bucking equipment.

Figure 31:
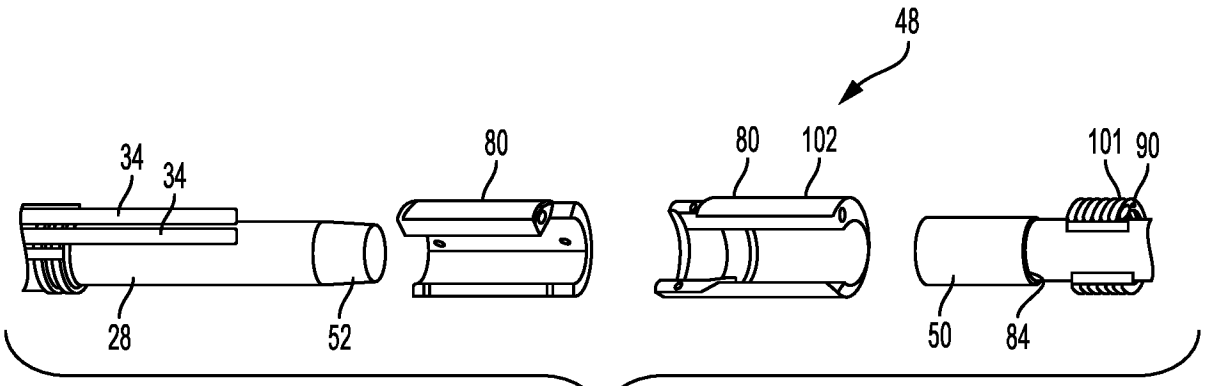
FIG. 31 is an illustration of a stage of manufacture for a screen assembly utilizing pin end and box end connection ends, according to an embodiment of the disclosure.
Figure 32:
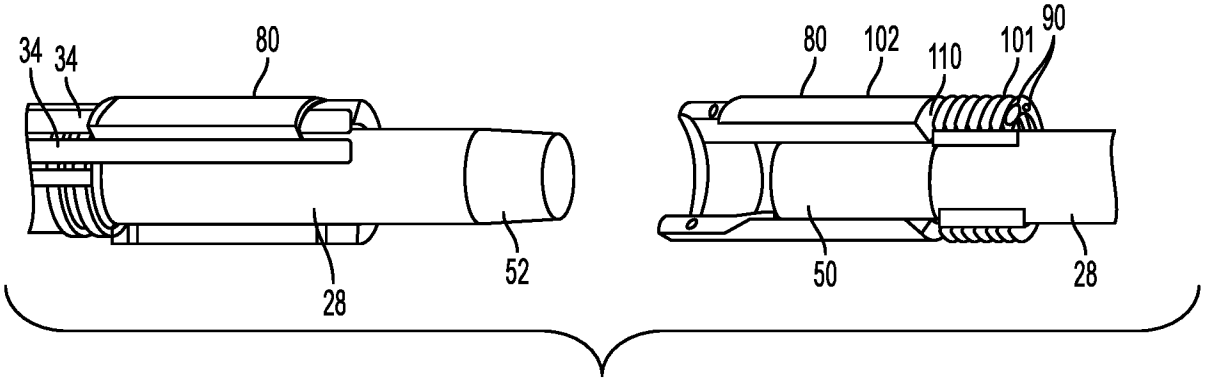
FIG. 32 is an illustration similar to that of FIG. 31 but showing connection ends in a different position during assembly, according to an embodiment of the disclosure.
Figure 33:
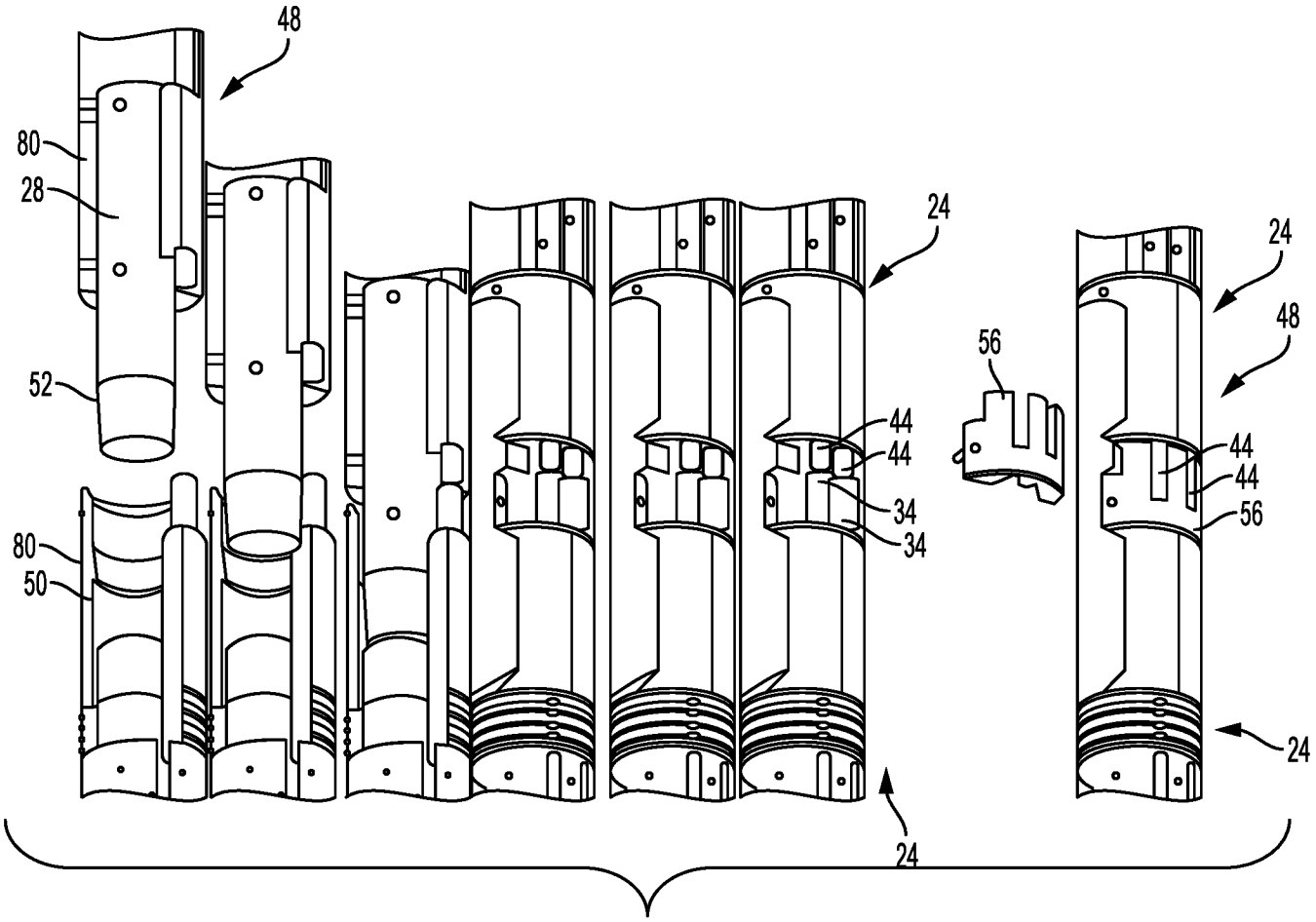
FIG. 33 is an illustration of sequential stages of coupling connection ends and alternate path tubes during rig make-up, according to an embodiment of the disclosure.

Referring generally to FIGS. 31-33, another embodiment and technique for coupling, e.g. making-up, a first screen assembly joint 24 to a second screen assembly joint 24 is illustrated. In this example, a two-part connection end sleeve 80 (see FIGS. 25 and 26) is used on the box end 50 of each screen assembly joint 24. As illustrated in FIG. 31, the first sleeve component 101 is initially slid along the base pipe joint 28 and engaged with box end 50 via, for example, features 98, 100. Subsequently, the second sleeve component 102 is slid over the box end 50 and fastened to the first sleeve component 101 by a suitable fastener 110, e.g. a weld. Similarly, a corresponding connection end sleeve 80 of the pass-through structure 48 may be slid over the pin end 52 of the next adjacent base pipe joint 28, as further illustrated in FIG. 32. By way of example, the corresponding connection end sleeve 80 may be secured to the corresponding base pipe joint 28 via a suitable fastening technique, e.g. by the set screws 88 described above.

Once the screen assemblies 24 are assembled, as illustrated in FIG. 32, the sequential screen assemblies 24 may be made-up on a rig as illustrated, for example, by the sequential stages of make-up illustrated in FIG. 33. As illustrated, the base pipe joints 28 are initially moved into proximity with each other and then threadably engaged until the corresponding sleeves 80 of the pass-through structure 48 are generally aligned to enable shifting of connectors 44 over the corresponding alternate path tubes 34. After shifting the connectors 44 into sealed engagement with the corresponding alternate path tubes 34, the cap 56 may be placed over the joined alternate path tubes 34, as illustrated.

Figure 34:
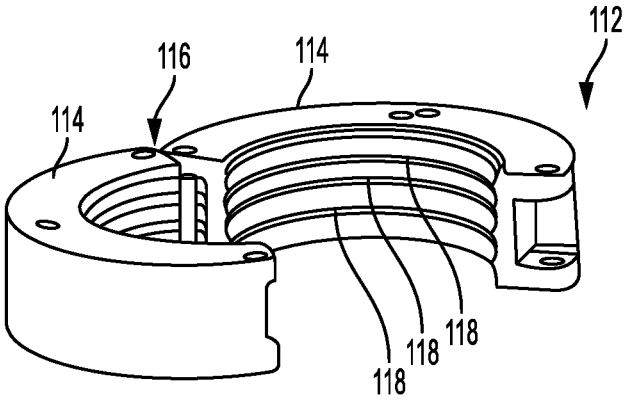
FIG. 34 is an orthogonal illustration showing an embodiment of a hinged collar which may be used to securely engage a connection end of a base pipe joint during make-up, according to an embodiment of the disclosure.
Figure 35:
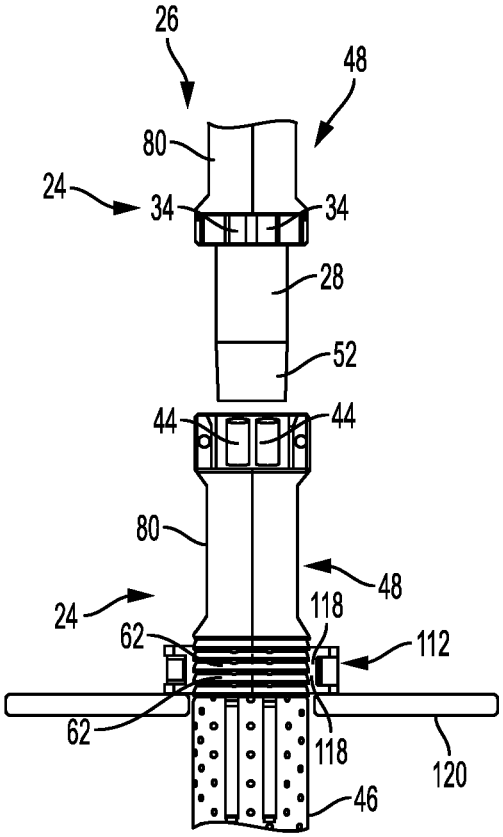
FIG. 35 is an illustration of the hinged collar shown in FIG. 34 engaged with a screen table during make-up of sequential base pipe joints on, for example, a rig, according to an embodiment of the disclosure.

Referring generally to FIG. 34, an embodiment of a tool 112 may be used to facilitate make-up of sequential screen assemblies 24 on the rig. In this example, the tool 112 comprises a collar, e.g. a hinged collar 112, constructed to facilitate engagement with the series of low-profile load shoulders 62 which may be located on a pass-through structure 48, e.g. on sleeve 80, or on another suitable portion of each screen assembly 24. The hinged collar 112 may comprise collar portions 114 pivotably coupled via a hinge 116, however other types of collars 112 may be utilized, e.g. multi-piece collars. Disposed along an interior of the hinged collar 112 is a series of internal load shoulders 118 which are arranged to engage corresponding load shoulders 62 of a corresponding screen assembly 24 when placed on a screen table 120, as illustrated in FIG. 35. The interlocked load shoulders 62 and internal load shoulders 118 enable axial load transfer in both directions, e.g. up and down directions.

Figures 36, 37, 38:
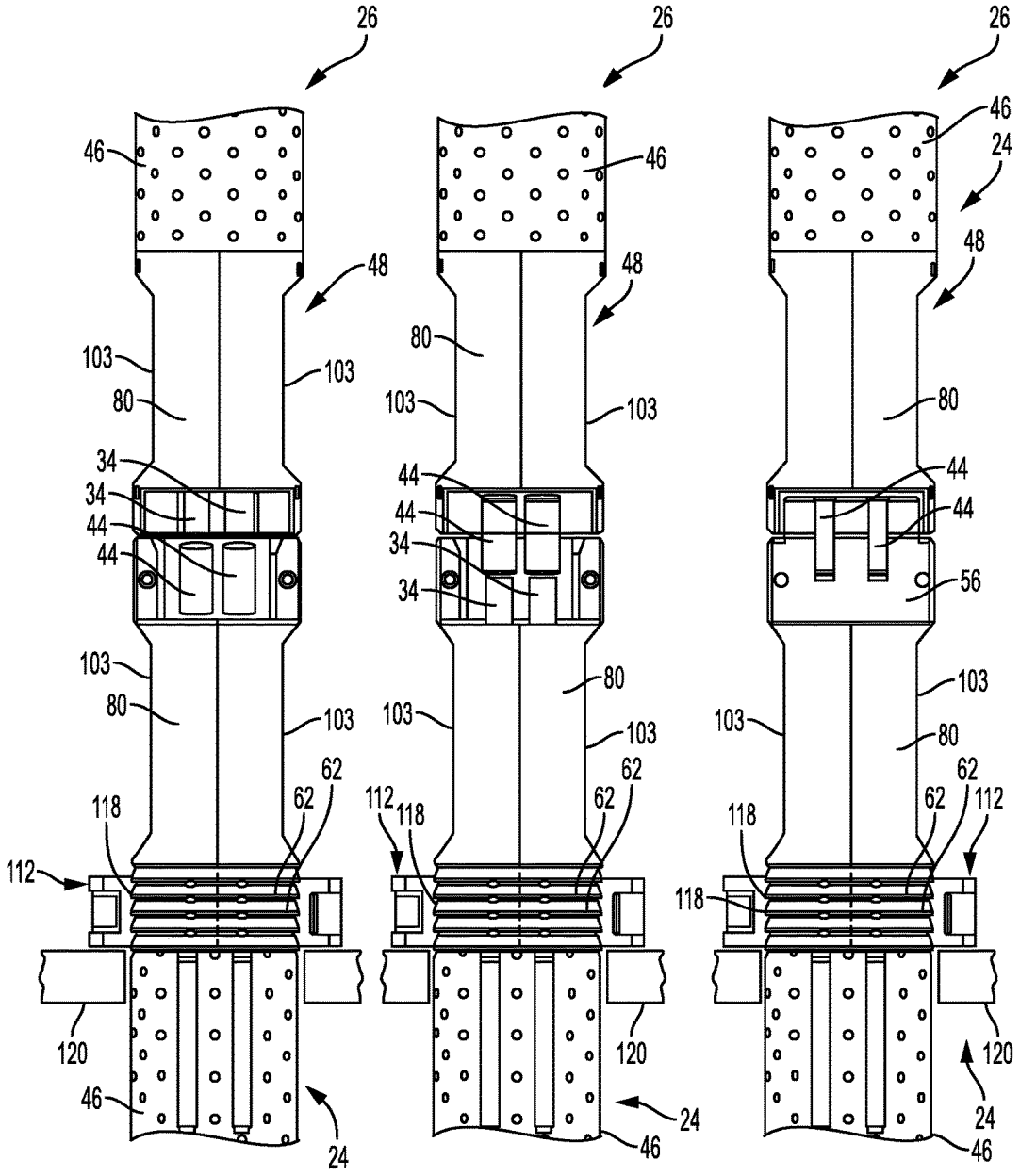
FIG. 36 is an illustration similar to that of FIG. 35 but showing a subsequent stage of the make-up, according to an embodiment of the disclosure.
FIG. 37 is an illustration similar to that of FIG. 36 but showing a subsequent stage of the make-up, according to an embodiment of the disclosure.
FIG. 38 is an illustration similar to that of FIG. 37 but showing a subsequent stage of the make-up, according to an embodiment of the disclosure.

As illustrated in FIGS. 35-38, once a first screen assembly 24 is secured on screen table 120 via hinged collar 112, a second or sequential screen assembly 24 may be moved into proximity with the first screen assembly 24 (see FIG. 35). The adjacent base pipe joints 28 are then threaded together until the corresponding alternate path tubes 34 are generally aligned, as illustrated in FIG. 36. This allows the connector or connectors 44 to be shifted so as to sealably couple the corresponding alternate path tubes 34 of sequential screen assemblies 24, as illustrated in FIG. 37. The cap 56 may then be placed over the coupled ends of the alternate path tubes 34 to protect the connection and to secure the connector(s) 44, as illustrated in FIG. 38.

Figure 40:
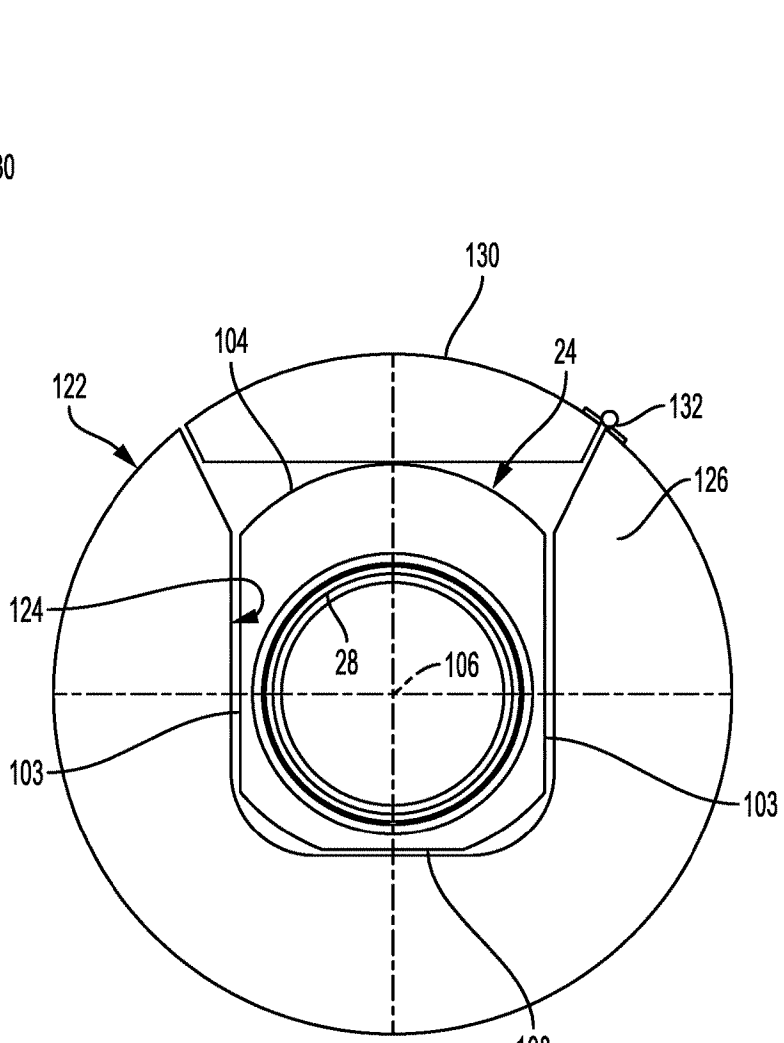
FIG. 40 is an illustration similar to that of FIG. 39 but showing the tongs in a different operational position, according to an embodiment of the disclosure.
Figure 39:
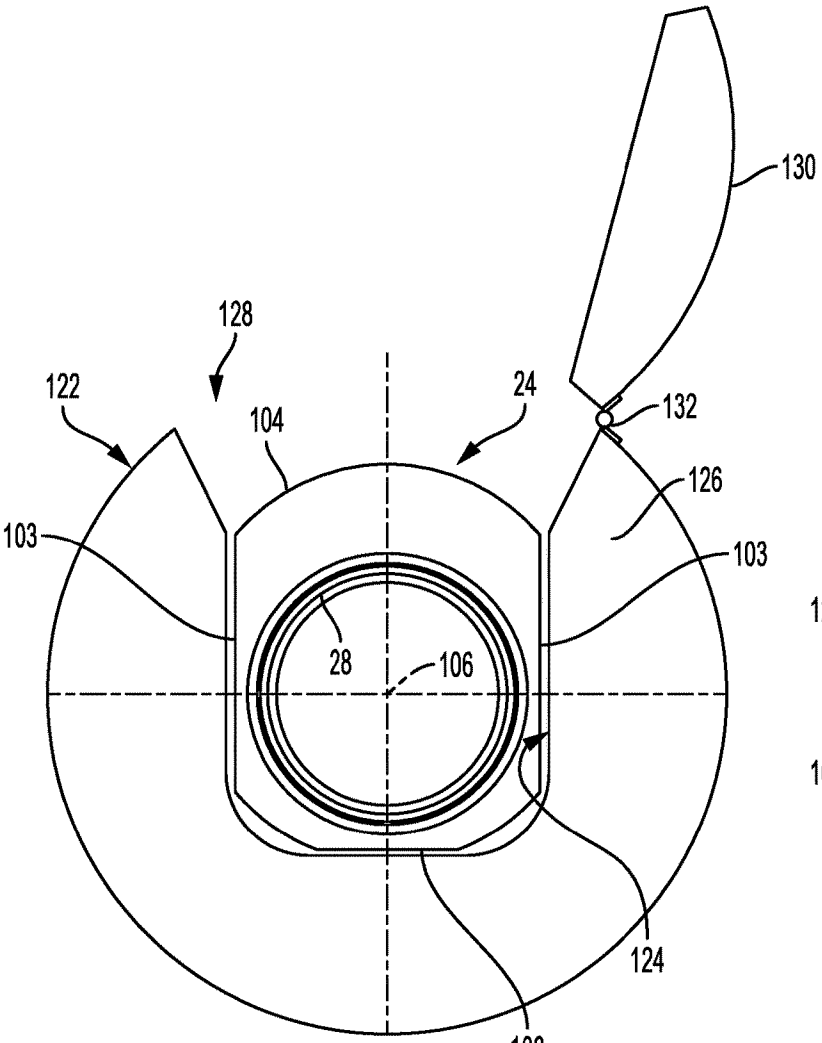
FIG. 39 is an illustration of an embodiment of tongs having a tong interface which facilitates make-up of certain embodiments of the adjacent joints described herein, according to an embodiment of the disclosure.

Referring generally to FIGS. 39 and 40, an embodiment of a tong device 122 has tongs to facilitate make-up of adjacent joints 24 on the rig. The tong device 122 is constructed with an internal, tong interface 124 which corresponds with the external shape of the corresponding joint 24. For example, the tong interface 124 may be constructed to match and engage the flat surfaces 103, 108 of the corresponding screen assembly joint 24. In this manner, engagement of the flat surfaces 103, 108 with tong interface 124 ensures the desired orientation of joint 24 so as to facilitate alignment of the base pipe axes 106 when sequential base pipe joints 28 and corresponding screen assembly joints 24 are made-up. In this example, the base pipe axes 106 also may be aligned with the central axis of the tong interface 124. It should be noted that tong device 122, with tong interface 124, may be used to engage screen assembly joints 24 in the region of flat surfaces 103, 108 illustrated in FIGS. 27-30 to facilitate handling, e.g. rotational coupling, of the joints when made-up.

In the specific embodiment illustrated, the tong device 122 is formed with a tong body 126 having tong interface 124 formed along its interior. The tong body 126 has an open end 128 to enable receipt of the corresponding joint 24 in a manner which properly aligns and holds the joint 24 via engagement of flat surfaces 103, 108 with the tong interface 124, as illustrated in FIG. 39. The tong device 122 also may comprise a tong closure 130 which may be selectively closed over open end 128 once the corresponding joint 24 is properly received therein. The tong closure 130 may have a variety of structures and may be coupled to tong body 126 via a variety of mechanisms. By way of example, the tong closure 130 may be pivotably coupled with tong body 126 via a hinge 132.

It should be noted that the various alternate path tubes 34, tube connectors 44, caps 56, and/or other features of the gravel packing assembly may be utilized with the various pass-through structures 48 and connector end sleeves 80 described above with reference to FIGS. 18-38. In the examples described herein, various combinations of alternate path tubes may be used in cooperation with various connectors to facilitate flow of fluid, e.g. gravel slurry, along the screen assembly string 26, e.g. across base pipe joint connections. The approach also facilitates make-up of the joint connections. However, many different numbers and arrangements of alternate path tubes and base pipe joints may be used in combination with other devices to facilitate gravel packing operations. Additionally, a variety of screen/filter media, inflow control devices, packers, and/or other components may be used in combination with the structures described herein to facilitate, for example, gravel packing system assembly, gravel packing operations, and production operations. In, for example, embodiments described above the alternate path tubes 34 comprise transport tubes coupled together by connectors 44, and those transport tubes may be coupled with packing tubes at suitable locations depending on the overall construction of the alternate path system.

Additionally, many types of materials, components, and component configurations may be used in constructing the gravel packing system. For example, the screen assembly screens may be made from a variety of woven and nonwoven materials in various patterns and arrangements. Similarly, the alternate path tubes may be made with various materials and combinations of materials. The base pipe joints may be perforated with many types and configurations of perforations to enable flow between the exterior and interior of the base pipe. The gravel packing system also may comprise several different numbers of base pipe tubing joints arranged with individual or multiple screen assemblies and various numbers and arrangements of slurry structures and/or alternate path structures.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a gravel packing system deployed in a wellbore and comprising:

a base pipe having a first base pipe joint and a second base pipe joint coupled at a base pipe joint connection;

a screen disposed around the base pipe; and a first alternate path tube disposed along the first base pipe joint and a second alternate path tube disposed along the second base pipe joint, the first and second alternate path tubes being positioned for alignment with each other when the first base pipe joint and the second base pipe joint are coupled via cooperating box and pin ends;

a connector movably coupled with at least one of the first or second alternate path tubes, the connector being movable to join the first alternate path tube with the second alternate path tube once the first base pipe joint is coupled with the second base pipe joint, wherein the alternate path tubes are approximately ⅛ to ⅜ of an inch shorter than a length of the corresponding base pipe, as measured from a base of the pin end to an end of a coupling shoulder at the box end; and a connection cap attachable into the gravel packing system at a location which covers the connector.

2. The system as recited in claim 1, wherein the gravel packing system further comprises a pass-through structure for receiving the first and second alternate path tubes, the pass-through structure being formed by connection end sleeves secured to adjacent ends of the first base pipe joint and the second base pipe joint.

3. The system as recited in claim 1, wherein the first and second alternate path tubes comprise transport tubes.

4. The system as recited in claim 1, wherein the first alternate path tube is one of a plurality of first transport tubes disposed along the first base pipe joint and the second alternate path tube is one of a plurality of second transport tubes disposed along the second base pipe joint.

5. The system as recited in claim 1, wherein the connector is slidably mounted on one of the first or second alternate path tubes in a manner which enables sliding engagement with the other of the first or second alternate path tubes.

6. The system as recited in claim 1, wherein the base pipe joint connection is a threaded connection having timed threads.

7. The system as recited in claim 1, wherein at least one of the first alternate path tube and the second alternate path tube is disposed in a pass-through structure having an over-sized slot to allow lateral space for alignment of the first alternate path tube with the second alternate path tube.

8. The system as recited in claim 1, wherein the connection cap is attachable via a pin having a spring-loaded member.

9. The system as recited in claim 1, wherein the gravel packing system further comprises a connection end sleeve mounted on at least one of the first base pipe joint and the second base pipe joint, the connection end sleeve having a series of low-profile shoulders positioned to enable support of the gravel packing system by a hinged collar on a screen table of a rig.

10. The system as recited in claim 1, wherein the gravel packing system further comprises a connection end sleeve comprising a plurality of notches which engage corresponding features on the first base pipe joint.

11. A method, comprising:

forming a gravel packing system with a screen assembly string having a base pipe with base pipe joints, and the screen assembly string further having alternate path tubes positioned along the base pipe joints;

coupling adjacent base pipe joints via cooperating box and pin ends such that corresponding alternate path tubes of the adjacent base pipe joints are disposed proximate to each other;

joining the corresponding alternate path tubes with a connector by sliding the connector from one of the corresponding alternate path tubes into engagement with the other of the corresponding alternate path tube, wherein the first and second alternate path tubes are approximately ⅛ to ⅜ of an inch shorter than a length of the corresponding base pipe, as measured from a base of the pin end to an end of a coupling shoulder at the box end; and enclosing and securing the connector with a cap.

12. The method as recited in claim 11, further comprising flowing a gravel slurry through the alternate path tubes disposed externally to the base pipe.

13. The method as recited in claim 11, further comprising using connection end sleeves to form a pass-through structure which receives the corresponding alternate path tubes.

14. The method as recited in claim 13, further comprising locating a series of flat surfaces on the connection end sleeves to facilitate make-up of the screen assembly string.

15. The method as recited in claim 11, further comprising providing at least one connection end sleeve with a series of low-profile shoulders positioned to enable support of the screen assembly string by a collar on a screen table of a rig.

16. The method as recited in claim 11, wherein joining comprises forming a seal between the connector and the corresponding alternate path tubes.

17. The method as recited in claim 11, further comprising providing at least one of the alternate path tubes with surrounding space for lateral movement to facilitate alignment of the corresponding alternate path tubes prior to joining the corresponding alternate path tubes with the connector.

18. The method as recited in claim 11, wherein enclosing comprises releasably attaching the cap.

19. A method, comprising:

providing a first base pipe joint of a base pipe with a first alternate path tube and a second base pipe joint of the base pipe with a second alternate path tube;

joining the first base pipe joint with the second base pipe joint via cooperating box and pin ends such that the first alternate path tube and the second alternate path tube are brought into dose proximity with each other at a location along the exterior of the first and second base pipe joints; and joining the first alternate path tube with the second alternate path tube by a connector movably mounted on at least one of the first or second alternate path tubes, wherein the first and second alternate path tubes are approximately ⅛ to ⅜ of an inch shorter than a length of the corresponding base pipe, as measured from a base of the pin end to an end of a coupling shoulder at the box end.

20. The method as recited in claim 19, further comprising covering the connector by a removable cap.

* * * * *